US005964238A

United States Patent [19]

Junkin

[11] Patent Number: 5,964,238

[45] Date of Patent: Oct. 12, 1999

[54] CONDENSATE DISCHARGE LINE TREATMENT

[75] Inventor: Ronald C. Junkin, Tampa, Fla.

[73] Assignee: Beth Good Junkin, Valrico, Fla.

[21] Appl. No.: 08/598,838

[22] Filed: Feb. 9, 1996

[51] Int. Cl.[6] ..... B08B 3/04; B08B 9/06

[52] U.S. Cl. ..... 137/15; 62/303; 134/99.2; 134/169 C; 137/240; 137/605; 222/148

[58] Field of Search ..... 137/240, 602, 137/605, 15; 134/99.2, 166 C, 169 C; 62/303; 222/148

[56] References Cited

U.S. PATENT DOCUMENTS

| | | | |
|---|---|---|---|
| 215,928 | 5/1879 | Hutchinson | 137/240 |
| 1,274,103 | 7/1918 | Story | 137/240 |
| 1,577,637 | 3/1926 | Hess | 137/240 |
| 1,885,977 | 11/1932 | Denison | 137/240 |
| 1,938,064 | 12/1933 | Carmine | 137/240 |
| 2,252,501 | 8/1941 | Foresman | 137/897 |
| 2,711,928 | 6/1955 | Randa | 137/897 |
| 3,550,612 | 12/1970 | Maxon | 137/240 |
| 4,580,726 | 4/1986 | Unger | 134/99.2 |
| 4,998,412 | 3/1991 | Bell | 62/303 |
| 5,379,605 | 1/1995 | Outlaw | 62/303 |
| 5,509,148 | 4/1996 | Steele et al. | 137/240 |
| 5,526,841 | 6/1996 | Detsch et al. | 137/240 |

*Primary Examiner*—George L. Walton
*Attorney, Agent, or Firm*—Charles A. McClure

[57] ABSTRACT

Condensate discharge line treatment to keep the line open, or to clear it if clogged. A valve is inserted into the discharge line and provided with an alternative inlet to receive flushing liquid. The valve inlet from the upstream part of the condensate discharge line is blocked by a valve member from time to time in favor of flow of the flushing liquid via the alternative inlet into the valve and out through the outlet into the downstream part of the condensate discharge line. The flushing liquid may contain a cleaning composition or even an algicide, which may be injected by manually or mechanically squeezing a flexible container of it to inject it into the flow of flushing liquid.

16 Claims, 3 Drawing Sheets

CONDENSATE DISCHARGE LINE TREATMENT

TECHNICAL FIELD

This invention concerns preventive and remedial maintenance for condensate lines, such as are associated with air conditioners, and relates especially to flushing of such lines to clear them when they are clogged, and to apparatus for doing so and preventing clogging.

BACKGROUND OF THE INVENTION

Condensate lines collect and drain off liquids (mostly water) produced in the operation of air-conditioning apparatus, and it is well known that such effluent discharge lines are likely to clog, as from contaminants present, and especially from growth of algae or similar organisms in such lines, with consequent clogging.

This problem has received attention, as evidenced by patents to inventors in the United States and elsewhere. U.S. patent examples include Pujol U.S. Pat. No. 4,722,127, which discloses cutting condensate discharge lines to enable servicing them with compressed air to clear them after becoming clogged or to keep them from clogging; Galvan U.S. Pat. No. 5,286,377, which teaches insertion of a baffled chemical insert in the line to discourage mineral deposits, bacteria, and fungi; and Keen U.S. Pat. No. 5,402,813, which offers an in-line chlorinator likewise.

However, there is still no consistent preventive maintenance of condensate lines, which continue to become clogged and overflow onto interior and exterior surfaces, with noxious and unsightly effects. The present invention resolves this problem simply and effectively.

SUMMARY OF THE INVENTION

A primary object of the present invention is to provide a maintenance procedure to prevent clogging of condensate discharge lines;

Another object of this invention is to provide ways and means for unclogging a clogged condensate discharge line;

A further object is to provide a valve useful in unclogging condensate discharge lines and in keeping them free from clogging;

Yet another object of this invention is to provide auxiliary ways and means of maintaining a condensate discharge line open; and A still further object of the invention is to accomplish the foregoing objects simply and inexpensively.

In general, the object of this invention are attained by temporarily blocking flow from an upstream condensate source into its discharge line, opening a path of fluid flow from an alternative source into the discharge line, thus flushing the discharge line with an alternative fluid while condensate source flow is blocked, then restoring the original discharge flow connections. Preferably, the alternative fluid is dosed with an algicide as a preventive.

Apparatus for accomplishing the foregoing procedures includes a valve connectable in a condensate line discharge path and having an outlet port to be connected to a downstream part of the path, a pair of inlet ports, one to be connected to an upstream part of the condensate line path, and another to be connected to a source of alternative fluid introducible into the downstream part of the path for the purpose of flushing it. More particularly, the valve has a movable internal valve member adapted to be actuated to close either of the inlet ports at any given time, but not to close both together.

Other objects of this invention, together with methods and means for attaining the various objects, will become apparent from the following description and the accompanying diagrams of at least one embodiment, presented by way of example rather than limitation.

DESCRIPTION OF THE INVENTION

Figure 1:
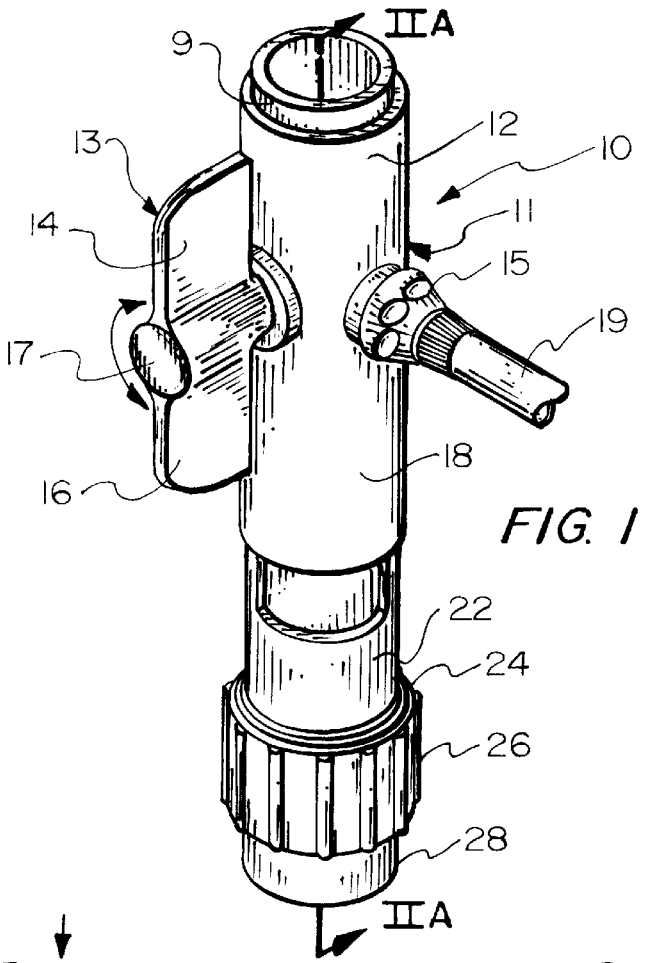
FIG. 1 is a perspective view of a manually actuatable valve and interconnecting lines (fragmentarily shown) of the valve assembly of this invention.

FIG. 1 shows, in perspective, partly cut away, valve assembly 10 of this invention, featuring valve 11 with condensate inlet end 12 from condensate line 9 at its top, and with outlet end 18 at its bottom entering drain line 22 having its own optional screw fitting.

The intermediate or body portion of the FIG. 1 valve is provided at the near left with rotatably (arrow) adjustable handle 15, including (in illustrated vertical position) aligned upper vane 14 and lower vane 16 flanking its transverse axial portion 17 joined to an internal valve member (shown in subsequent views). Joining the valve body via fitting 15 (or quick connect/disconnect fitting) at a like intermediate level is small flushing line 19 at the near right. Lower end 18 of the valve surrounds close-fitting downstream drain line 22, part of whose top end is cut away to reveal its hollow interior, whereas its bottom end 24 is externally threaded into optional internally threaded screw-connector 26 of downstream line 28.

Figure 2A:
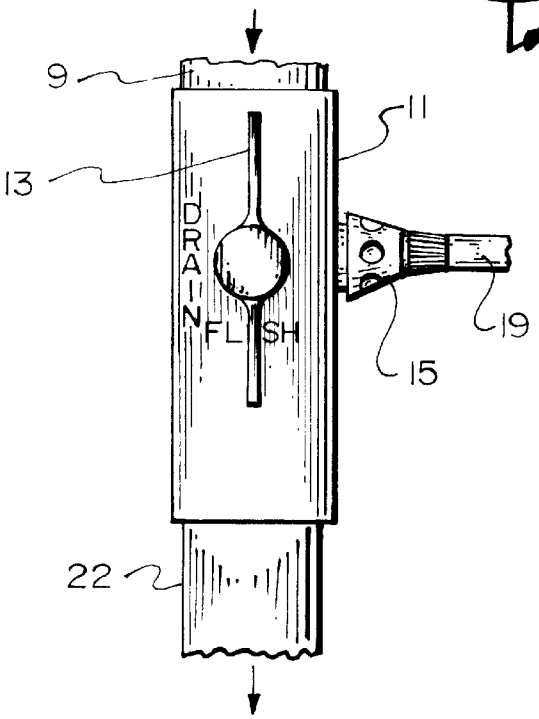
FIG. 2A is a sectional elevation of the valve of FIG. 1, with a first one of the inlet ports closed and the second inlet port open.
Figure 2B:
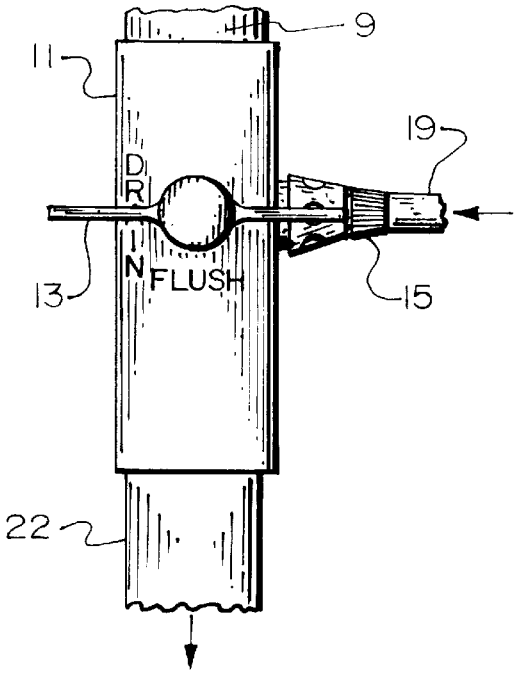
FIG. 2B is a sectional elevation of the same valve with the second one of the inlet ports closed and the first inlet port open.
Figure 3A:
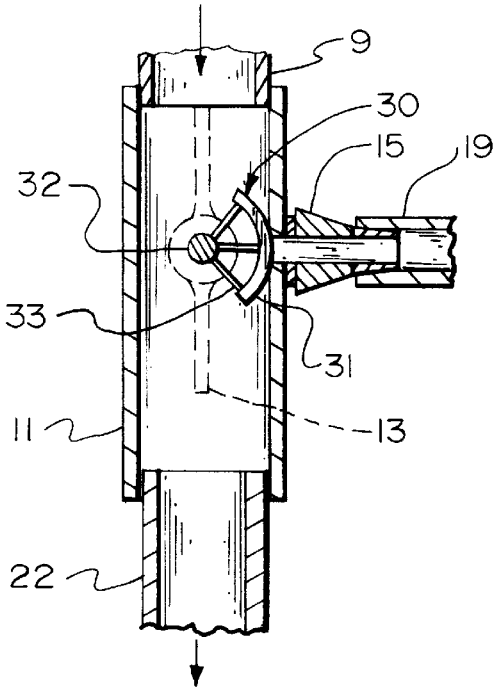
FIG. 3A is a side elevation of a mechanically assisted valve of this invention in the valving position corresponding to FIG. 2A.

FIGS. 2A and 2B show, in side elevation, respective alternative marked settings of valve 15: (i) DRAIN, with handle vanes vertical and parallel to both condensate line 9 and drain line 22; and (ii) FLUSH, with handle vanes horizontal and parallel to intersecting flushing line 19. An arrow from the condensate line shown entering the top of valve 11 in FIG. 3A is replaced in FIG. 3B by an arrow entering the valve sidewise from the flushing line. Both views show similar exiting or outlet arrows below the drain line (and valve).

Figure 3B:
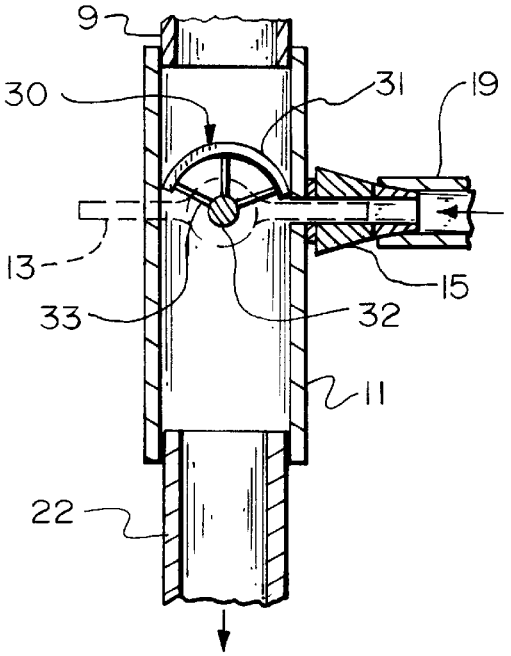
FIG. 3B is a side elevation of a mechanically assisted valve of this invention in the valving position corresponding to FIG. 2B.

FIGS. 3A and 3B show, in side sectional elevation, the respective valve settings shown in FIGS. 2A and 2B but now featuring the valve interior, especially valve member 30 having arcuate seat 31 supported on several spokes 33 from axle 32 rotatable by valve handle 13. Handle 13 is superimposed in phantom onto both views.

FIG. 3A shows the normal condensate drain position, wherein the arcuate seat of valve member 30 covers (seals off) the entry from flushing line 19, while enabling liquid from condensate line 9 to go through. As a condensate line is hardly ever full, the valve member does not impede passage of condensate liquid as it drains to waste.

FIG. 3B shows the alternative (intermittent) flushing position, wherein arcuate valve member 30 has been rotated a quarter turn from normal condensate drain position to hold up liquid from condensate line 9. In this position, flushing liquid from side line 9 enters the valve and flows out and into drain line 22, which in the absence of timely flushing may become clogged with solidified condensate and/or with growth of algae because of the customary lack of full flow of liquid therethrough. Hence, intermittent connection of the flushing line provides full flow through the drain line and enables remedying (preferably preventing) line clogging by condensate solids and/or by algae or similar biological growths in its interior.

Figure 4:
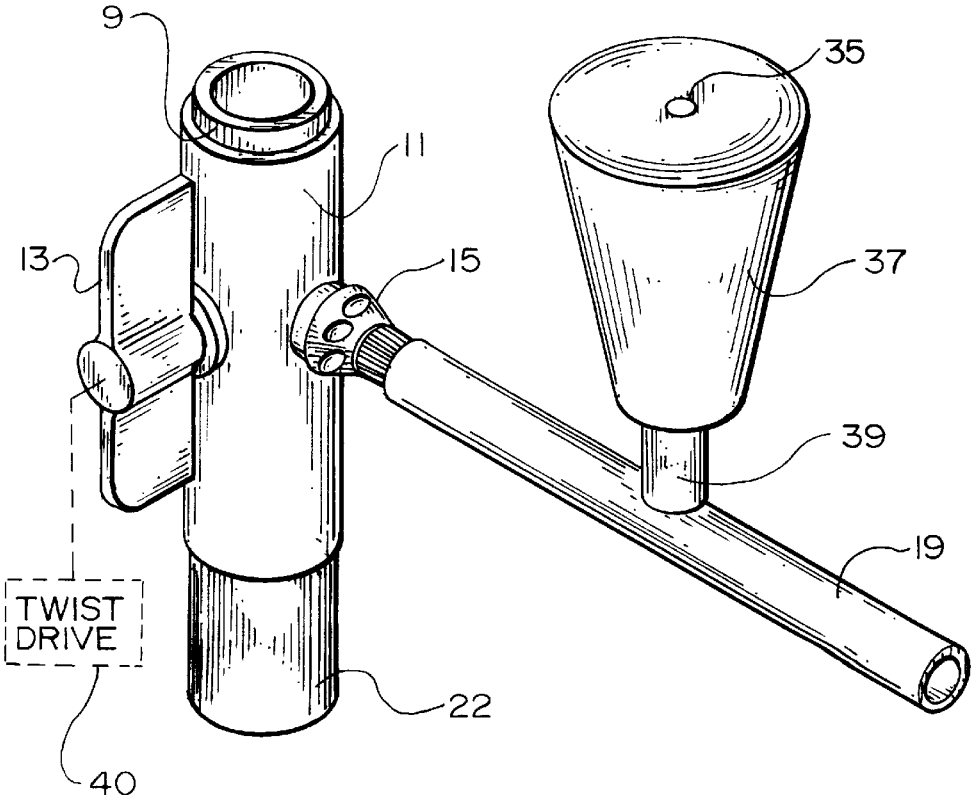
FIG. 4 is a fragmentary perspective view of a valve assembly of this invention, including a flushing line with a flexible container of algicide interconnected.

FIG. 4 shows, in perspective, valve 11 connected to flushing line 19 entering at the side, as before, but now container 37 of cleaning solution is attached to the flushing line by short pipe 39. Relief valve 35 in the top of the container admits air, as cleaning solution flows from the container into the flushing line and on into valve 11 and out of drain line 32. Not shown (but readily visualizable) is an optional venturi from pipe 39 within flushing line 19 and oriented toward the downstream position. A dashed line leads from the center of adjustable handle 15 to TWIST DRIVE block 40, shown further in the next view, which is also described below.

Figure 5:
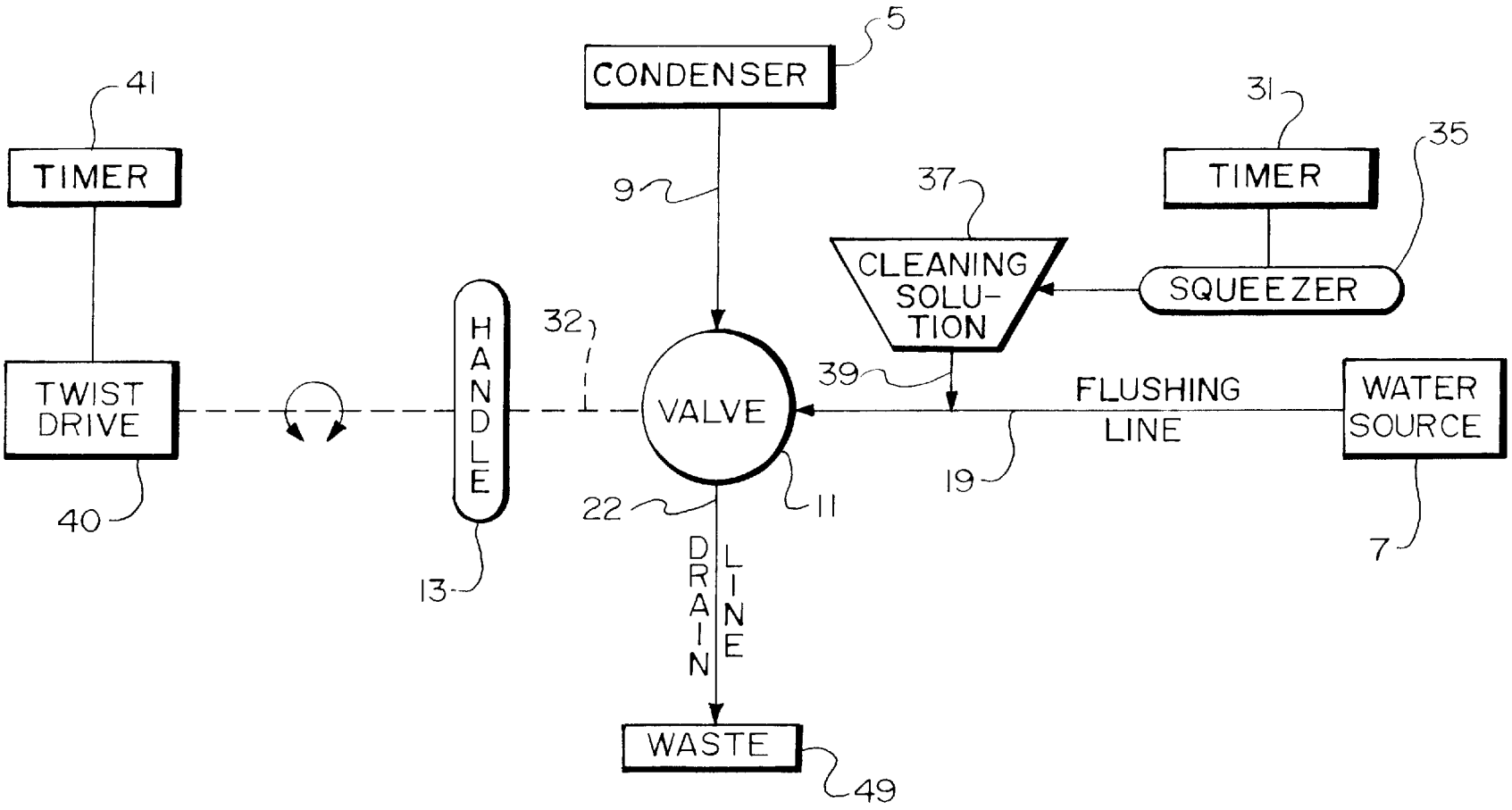
FIG. 5 is a block diagram of an automated flushing embodiment.

FIG. 5 shows, in schematic or block diagram form, my preferred further embodiment of the already described basic elements of this invention, especially for supplementing manual apparatus and operation by automatic mechanical or electromechanical means and methods.

Valve 11 is shown schematically at the center of this view with other apparatus arranged around it, beginning with CONDENSER at the top, which may be connected to a heat exchanger such as is present in industrial processes, or in air conditioning for buildings, etc. Line 9 leads from the condenser to VALVE 11 as already described. At the left is manually operable valve HANDLE 13 on its axle 32, but further left is TWIST DRIVE mechanically connected (as indicated by dashed line) to the handle, and surrounded by a double-ended arrow to suggest its quarter-turn or equivalent adjustability. TIMER 41 located above the TWIST DRIVE is provided to switch from a normally prevailing setting for liquid flow from CONDENSER 5 into DRAIN LINE 22 and on to WASTE 49, to the alternative setting wherein flow from WATER SOURCE 7 at the far right proceeds through FLUSHING LINE 19 past CLEANING SOLUTION 37 in the illustrated trapezoidal container into VALVE 11 and out DRAIN LINE 22, also to WASTE 49. At the right of the CLEANING SOLUTION container, which is preferably flexible, is SQUEEZER 35 associated with TIMER 35. Whereas a flexible container can be squeezed to expel part of its contents, as into the water flowing to VALVE 15 via FLUSHING LINE 19, the bother of doing so manually can be avoided and a more measured result be obtained by electrically or mechanically timed application of squeezing force or by equivalent injection of air into the container's relief valve (35 in FIG. 4) with or without a preferred venturi within the flow line.

This invention does not require any unusual materials but may be practiced with essentially off-the-shelf items, such as the valve assembly, piping, and the preferably flexible container for algicide (and the algicide itself) or the like, when manually operated, and the drive means and timers when mechanically assisted.

In practice, the usual time period between clogging episodes in the condensate drain line may be sufficiently known, even though perhaps varying with a seasonal (or other) pattern, to be reasonably predictable. If such episodes tend to occur monthly, it is advisable to flush the line manually on a weekly basis to avoid recurrence. If clogging episodes normally occur more often, it may be preferable to automate the system, as in FIG. 5, to give the line a flushing shot periodically on a timed basis, either evenly spaced or—if a condensation cycle is predictable—closer spaced in heavy periods and further apart when lighter periods are predicted.

The benefit of avoiding messy clogging and overflow annoyances is obvious. What is not so apparent is that a system well designed according to the present invention can actually save money despite its installation and operating costs, which are relatively modest.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

The claimed invention:

1. A flow-control valve disposed within a condensate line discharge path for selectively blocking and unblocking said discharge path from a pair of fluid sources, and comprising a first inlet port, adapted to be connected to an upstream part of the condensate line discharge path from a first fluid source;

an outlet port, adapted to be connected to a downstream part of the condensate line discharge path;

a second inlet port, adapted to be connected to a source of alternative fluid as a second fluid source, introducible into the condensate line discharge path for the purpose of flushing it; and a single rotatable internal valve means, solely disposed within the condensate line discharge path for alternately selectig either one of the sources, adapted to close either inlet port at any given time, but not to close both together.

2. Valve according to claim 1, so connected to a condensate line discharge path, and wherein the valve outlet port is adapted to remain open regardless of actuation of the movable internal valve means to close either of the inlet ports.

3. Valve according to claim 1, so connected to a condensate line discharge path, and wherein the movable internal valve means is actuatable manually to be rotated a partial turn to close or open either of the valve inlet ports alternatively.

4. Valve according to claim 1, so connected to a condensate line discharge path, and wherein the movable internal valve means is actuatable with mechanical assistance to close either of the valve inlet ports alternatively.

5. Valve according to claim 4, having timing means to effect actuation of the movable internal valve means and thereby to interconnect a source of alternative fluid into the downstream part of the condensate line discharge path for the purpose of flushing it.

6. The improvement according to claim 1, including also mechanical means for introducing cleaning liquid into the second inlet port and thereby into the valve means and out into the downstream part of the condensate line.

7. The improvement according to claim 6, wherein the cleaning liquid is adapted to be expelled bit by bit from a container thereof into the flow of alternative fluid.

8. The improvement according to claim 7, wherein the container is flexible and is thereby adapted to be compressed at intermittent intervals to expel a bit of cleaning liquid into the flow of alternative fluid to flow downstream.

9. The improvement according to claim 8, including mechanical squeezing means connected to the flexible container to cause it to expel cleaning liquid into the alternative line to flow downstream.

10. Method of treating a pump-free downstream discharge line normally connected to an upstream condensate source and alternately connectable to an alternative fluid source by a two-way inlet valve, a single outlet valve disposed solely within said discharge line, said two-way valve having a handle for switching between the two sources, comprising the alternative steps of performing a simple one-way partial turn of the valve handle, blocking flow internally of said discharge line by said valve from the alternative fluid source upstream to the condensate source, and opening a path of fluid flow from the alternative source into the discharge line, thereby flushing the discharge line with an alternative fluid while condensate source flow is blocked; and a simple reverse partial turn of the valve handle, blocking flushing flow from entering the discharge line and enabling flow to resume from the condensate source, downstream into and through the flushed discharge line.

11. Method of treating a condensate discharge line according to claim 10, wherein such partial turns of the valve handle are performable independent of accumulated discharge line condensate, and including the step of performing the one-way partial turn of the valve handle to disconnect the condensate source line from the downstream discharge line and to connect the flushing line thereto irrespective of condensate accumulation in such downstream line.

12. Method according to claim 11, including a subsequent step of giving the valve handle a reverse partial turn to disconnect the flushing line from the downstream discharge line and to reconnect the upstream condensate source to such downstream line.

13. Method according to claim 12, including the further step of performing the recited steps on a predetermined timed basis, rather than upon a discharge accumulation demand basis.

14. Method according to claim 10, including the step of manually introducing cleaning liquid into the path of flushing fluid flow.

15. Method according to claim 10, including the step of mechanically introducing cleaning liquid into the path of flushing fluid flow.

16. Method according to claim 10, including the step further of including algicide in the cleaning liquid and so into the path of flushing fluid flow.

* * * * *